United States Patent [19]

Norman

[11] 4,169,682

[45] Oct. 2, 1979

[54] PRINTER MECHANISM

[75] Inventor: Lloyd E. Norman, Dallas, Tex.

[73] Assignee: Texas Instruments Incorporated, Dallas, Tex.

[21] Appl. No.: 859,765

[22] Filed: Jan. 31, 1978

[51] Int. Cl.[2] ..... B41J 3/20

[52] U.S. Cl. ..... 400/120; 346/76 PH; 400/55

[58] Field of Search ..... 219/216; 346/76 R, 76 TPH, 346/139 C, 155, 165; 400/55-57, 59, 118-121; 403/115, 116, 122

[56] References Cited

U.S. PATENT DOCUMENTS

| | | | |
|---|---|---|---|
| 3,115,382 | 12/1963 | Morse | 346/139 C |
| 3,824,602 | 7/1974 | Gulati | 346/139 C |
| 4,000,393 | 12/1976 | Cochran et al. | 219/216 |
| 4,066,369 | 1/1978 | Furtah | 403/115 |
| 4,090,059 | 5/1978 | Kilby et al. | 219/216 |

FOREIGN PATENT DOCUMENTS

| | | | |
|---|---|---|---|
| 473488 | 1/1972 | Japan | 346/139 C |
| 294161 | 5/1971 | U.S.S.R. | 400/120 |

*Primary Examiner*—Paul T. Sewell

*Attorney, Agent, or Firm*—Stephen S. Sadacca; James T. Comfort; Melvin Sharp

[57] ABSTRACT

Described is a printer mechanism which includes a platen rotatably mounted above a base, a medium upon which printing is to be accomplished and a printer unit disposed in printing relationship to the medium and the platen. A holder holds the printer unit and includes a ball and socket assembly for permitting the holder and printer to pivot about first and second orthogonal axes with respect to the platen. The holder also includes a projection which projects into a channel for inhibiting the holder and the printer unit from pivoting about a third axis, the third axis being orthoganol to both a first and second axes. The channel and an end of the ball and socket assembly are attached to the base. The printer unit is preferably of a non-inpact type such as a thermal printer unit which is mounted on a ceramic substrate for instance. The holder is urged toward the platen by means of a spring, which is attached to the holder and to the base. This mechanism enables a relatively wide printhead to follow small irregularities in the printing medium and in the platen and substantially even pressure is thereby applied across the printhead to provide uniform printed characters.

24 Claims, 9 Drawing Figures

PRINTER MECHANISM

BACKGROUND OF THE INVENTION

This invention deals with printer mechanisms using non-impact type printers and more specifically with printer mechanisms using relatively wide thermal printheads having a plurality of mesas adapted for printing a plurality of characters as the same time. The relatively wide printhead must be pressed against a printing medium which is driven by a platen. To achieve uniform print density and clarity, it is desirable that the pressure across the entire printhead be substantially the same.

In the prior art, non-impact type printhead have moved across the print medium to form characters in a step-by-step fashion. The printhead required for this type printer is generally quite small and therefore the application of even pressure is a relatively simple matter. However, as the printhead is made wider, slight variations in the platen and in the print medium may cause the printhead to fully contact one portion of the medium and bearly touch other portions. To overcome this problem, prior art techniques have envolved the very carefully machining of the cylinder-shaped platten to ensure surface uniformity and the use of very tight construction tolerances to assure that the plane in which the printheads occur is tangential to the platen.

Also in the prior art, as exemplified in U.S. patent application Ser. No. 680,835, relatively complex printhead alignment mechanisms have been used to assure that relatively wide printheads may be urged against a platen with substantially even pressure thereby yielding highly satisfactory print density and clarity. The print alignment mechanism of U.S. patent application Ser. No. 680,835 is often embodied in printing type calculators. With the advent of large scale integration techniques which have reduced the number of chips in typical calculators to as few as a single chip, the cost of calculators in general to the consuming public has dramatically dropped. While the printhead alignment mechanism of U.S. patent application Ser. No. 680,835 is a satisfactory design, the relative complexity thereof results in a comparatively expensive printer unit for a desk model printing calculator for instance.

It was therefore an object of this invention that an improved printer mechanism be provided for printing calculators.

It was another object of this invention that a relatively wide printhead be disposed with substantially even pressure against a platen.

It was yet another object of this invention that the resulting printer unit utilize a small number of parts which may be easily assembled and inexpensively procured.

The foregoing objects are achieved as is now described. A platen is rotatably mounted above a base. A medium upon which printing is to occur, preferably thermally sensitive paper, is disposed adjacent to the platten. A relatively wide thermal printhead is disposed against the medium by means of a holder. The holder is mounted on a stand which is connected to the base; the mount is preferably provided by a ball and socket arrangement which permits the holder to pivot about first and second orthogonal axes with respect to the platen. The holder and stand also include a projection and channel arrangement to inhibit the holder from pivoting about a third axis, the third axis being orthogonal to both the first and second axes. The holder includes a lead frame assembly, the ends of which are formed to provide electrical contacts in the holder. The contacts in the holder are disposed in contacting relationship to contacts on the thermal printhead when the thermal printhead is retained by the holder. The lead frame is preferably disposed in two major planes, one of which is preferably essentially parallel to a major plane of the holder. The other end of the lead frame is preferably connected to a printed circuit board on which the other electronic components associated with the printer are preferably mounted. A spring is preferably connected to the holder and to the base for urging the holder toward the platen.

BRIEF DESCRIPTION OF THE DRAWINGS

The novel feature's believed characteristic of the invention are set forth in the appended claims. The invention itself, however, as well as the preferred mode of use, further objects and advantages thereof, will best be understood by reference to the following detailed description of an illustrative embodiment when read in conjunction with the accompanied drawings, wherein:

DETAILED DESCRIPTION

Figure 1:
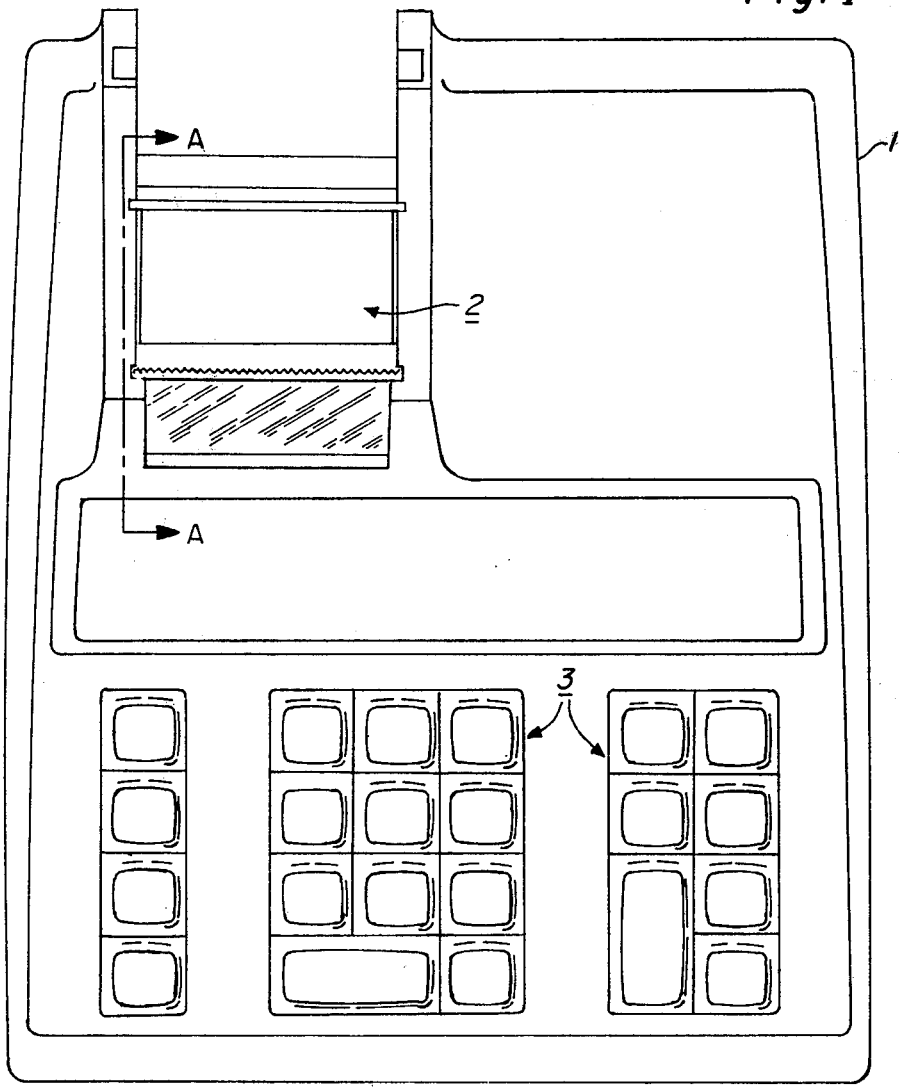
FIG. 1 is a perspective view of an electrode desk model printing calculator of the type which may embody the present invention.

Referring now to FIG. 1, there is shown a desk model printing calculator of the type which may embody the present invention. The calculator includes a case 1 which may be formed of injection molded plastic, for instance. The calculator includes a printer unit 2 and a keyboard 3. Printer unit 2 is preferably a thermal type of printer for printing on thermally sensitive paper.

Figure 2:
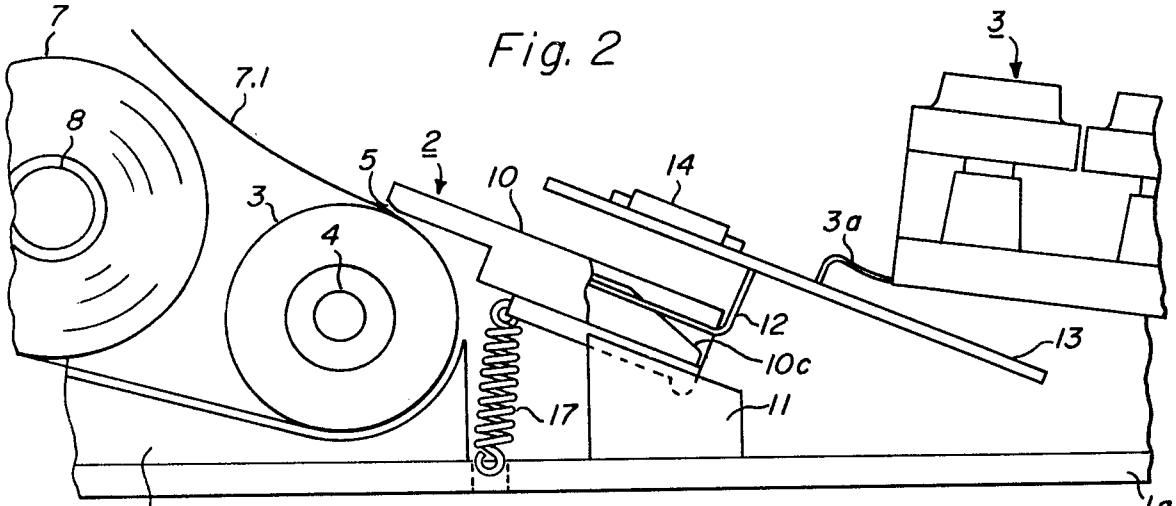
FIG. 2 is a side sectional view through an electronic calculator and shows the platten, holder, spring and various other components, the section being shown at A—A in FIG. 1.
Figure 3:
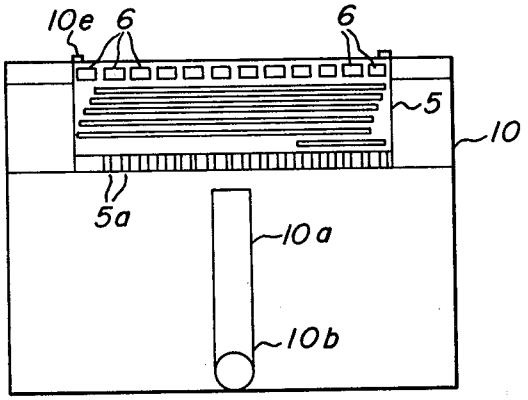
FIG. 3 is a bottom view of the holder.

In FIG. 2, there is shown a portion of a section view generally taken along section A—A in FIG. 1. The calculator case 1 is normally made in two or more pieces; in FIG. 2 only a portion of the bottom portion 1*a* of case 1 is shown for sake of clarity. Printing unit 2 includes a platten 3 which rotates on a spindle 4 and a printhead holder 10 which preferably receives a ceramic substrate 5. On the substrate 5 are mounted groups of thermal printing mesas 6 (FIG. 3). Methods of manufacturing groups of thermal printing mesas and disposing the same on substrates are taught in U.S. Pat. Nos. 3,496,333 and 3,982,093, for example.

A roll of paper 7 with the end thereof 7.1 being fed around platen 3 and between platen 3 and printing mesas 6 is also shown in FIG. 2. Roll of paper 7 normally is supported by a spindle 8. The ends of spindle 8 and spindle 4 are supported by structure not shown in FIG. 2 for sake of clarity; however, we have found that base 1*a* of case 1 is easily injection molded and that structure for supporting spindles 8 and 4 may be easily formed at the same time, if desired. Normally platen 3 and spindle 4 are coupled to a stepping motor for stepping paper 7.1 past printing mesas 6 when advancing the paper or during printing operations. The stepping motor also is not shown in FIG. 2 for sake of clarity. Base 1*a* of case 1 includes structure 9 for simplifying the insertion of end of paper 7.1 into printer 2. Base 1*a* also includes a stand 11, which will be described subsequently, for supporting holder 10.

Referring briefly to FIG. 3, there is shown a bottom view of holder 10. Substrate 5, on which the thermal printhead mesas 6 are mounted, is shown inserted in a slot 15 (see FIG. 6). Conductive ribbons 5*a* affixed to substrate 5 interconnect contacts 16 (FIG. 6) in slot 15 with thermal printheads 6. The bottom of holder 10 includes a generally rectangular shaped projection 10*a* and a spherically shaped projection 10*b*. As will be seen, the sperically shaped projection 10*b* mates with a spherical cavity 11*b* in stand 11 to form a ball and socket pivot arrangement. Further, projection 10*a* is disposed in a channel 11*a* in stand 11 for inhibiting holder 10 from yawing, that is, rotating about an axis essentially normal to the major plane of member 10, and intersecting spherical projection 10*b*, which axis is shown at "C" in FIG. 4.

Considering FIG. 2 again, member 10 is preferably provided with a lead frame 12 which is inserted into holes in printed circuit board 13 and soldered to conductors formed thereon. Printed circuit board 13 is disposed in a plane essentially parallel to the major plane of holder 10. Lead frame 12 is disposed in essentially two planes, one plane being essentially parallel to the major plane of member 10 and the other plane being set at approximately right angles thereto and thus essentially normal to the major plane of holder 10. Lead frame 12 is preferably comprised of a metallic material and the ends of which (which are not shown in FIG. 2) form contacts for mating with conductive ribbons 5*a* on substrate 5. Keyboard 3 is also coupled to conductive printed circuit wiring on printed circuit board 13 via conductors 3*a* and one or more integrated circuits 14 are also preferably interconnected with conductors formed on printed circuit board 13.

Figure 4:
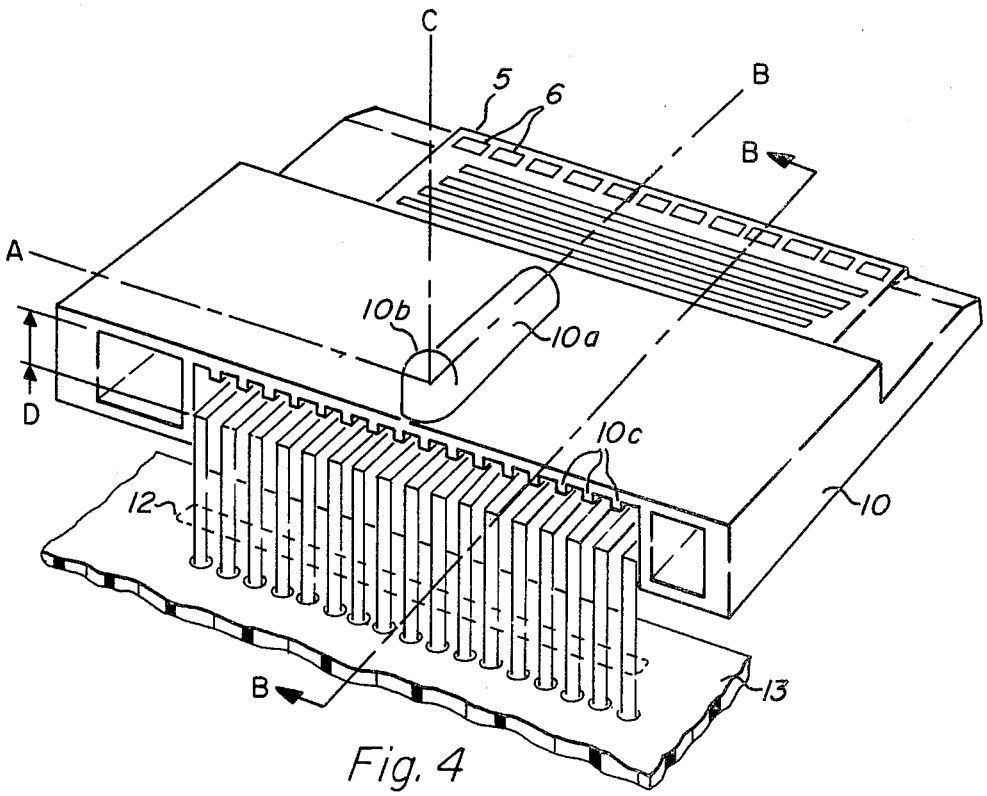
FIG. 4 is a bottom perspective view of the holder, lead frame and a portion of the printed circuitboard.

Referring now to FIG. 4, there is shown a perspective bottom view of holder 10, lead frame 12 and a portion of printed circuit board 13. Holder 10 is shown with ceramic substrate 5 inserted in slot 15 (FIG. 6) therein. Lead frame 12 is shown with seventeen individual conductors which are separated one from another with tines 10*c*. Of course, the number of such individual conductors is a design choice. Referring again briefly to FIG. 2, the side of holder 10 is shown partially cutaway to expose a conductor of lead frame 12 enterring holder 10 and a tine 10*c* which gradually increases in height as it extends from the front to the middle of holder 10. Again in FIG. 4, projections 10*a* and 10*b* are shown with additional clarity. It can be seen that projection 10*b* is essentially cylindrucally shaped at the lower portion thereof and topped with a section of a sphere whose radius equals the radius of the cylindrical portion. Projection 10*a* is essentially defined by a rectangular projection which is topped by a section of a cylinder whose diameter is equal to the width of the rectangle. The width of the rectangle also equals the diameter of the cylinder which makes up the lower portion of projection 10*b*.

Figure 5:
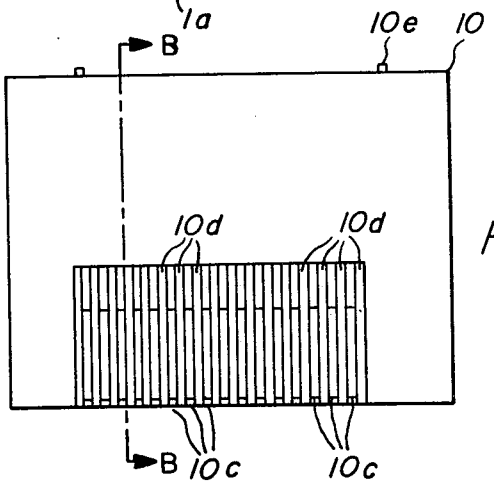
FIG. 5 is a top view of the holder.

Turning briefly to FIG. 5, there is shown a top view of holder 10 (without showing lead frame 12 for sake of clarity). As can be seen, tines 10*c* define channels 10*d* for receiving the conductive members of lead frame 12.

Figure 6:
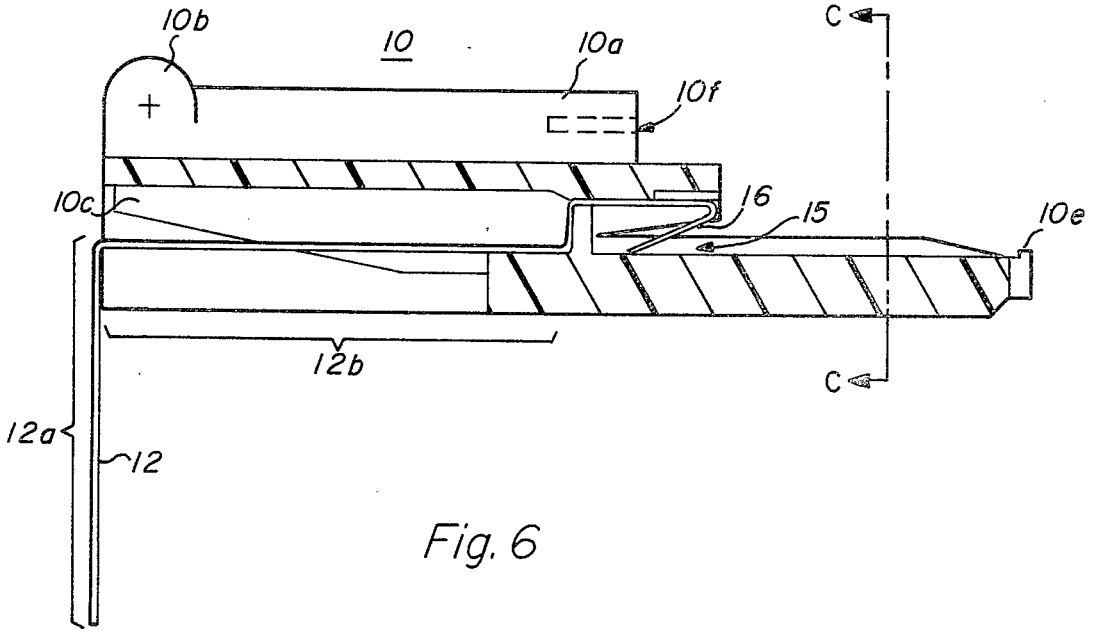
FIG. 6 is a sectional side view of the holder, the section being shown at B—B in FIGS. 4 and 5.

FIG. 6 is a side sectional view through holder 10, which section is taken at B—B as is shown in FIGS. 4 and 5. In FIG. 6 is shown an individual conductor from lead frame 12, which is shown disposed in two major planes defined by portions 12*a* and 12*b*. The end of the conductor is formed to provide a contact 16 which contacts one of the conductive ribbons 5*a* (FIG. 3) on substrate 5 when substrate 5 is received into slot 15. Nipples 10*e* in combination with contacts 16 act to retain substrate 5 in place when it is received in slot 15. Also shown in FIG. 6 are aforemention projections 10*a* and 10*b* as well as on tine 10*c*. Holder 10 is preferably made from an injection molded plastic, such as a glass filled polyester. We have found that the plastic manufactured by General Electric under the name VALOX 420-94V-O provides satisfactory results.

Figure 7:
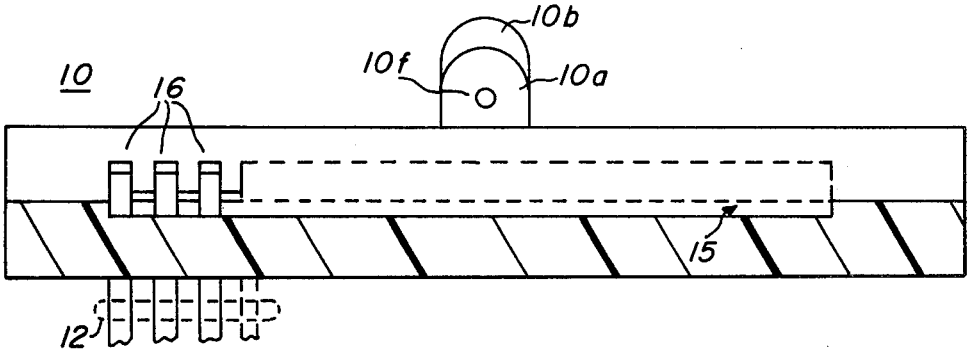
FIG. 7 is a sectional front view of the holder, the section being shown at C—C in FIG. 6.

A front sectional view of holder 10 is shown in FIG. 7, which section is taken along C—C in FIG. 6. In FIG. 7 are shown three of the contacts 16, the remainder not being shown in detail for simplicity sake. Extending below the three contact 16 are three of the individual members of lead frame 12, an end of each forming contact 16 as is shown in FIG. 6. Projections 10*a* and 10*b* are again shown and projection 10*a* is shown with an opening 10*f* for receiving an end of spring 17 (FIG. 2).

Figure 8:
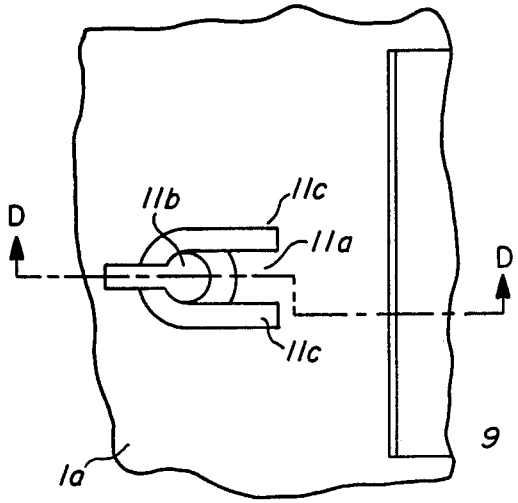
FIG. 8 is a plan view of the stand which mounts the holder.
Figure 9:
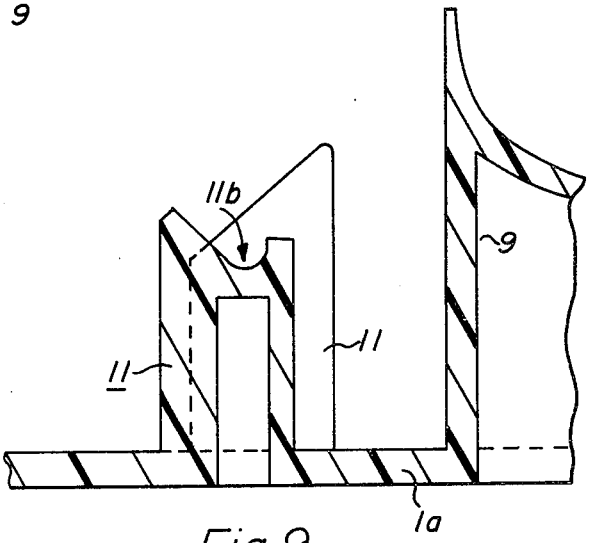
FIG. 9 is a section view through the stand, which section is taken at D—D in FIG. 8.

Stand 11 is shown in plan view in FIG. 8. Stand 11 includes a spherical shaped cavity 11*b* for receiving projection 10*b* and a channel 11*a* which is defined by tines 11*c*. In FIG. 9, stand 11 is shown in a section view, that section being shown at D—D in FIG. 8. In FIG. 9 cavity 11*b* is shown again along with one of the tines 11*c* which define channel 11*a*. Also shown in FIGS. 8 and 9 is structure 9 for guiding end of paper 7.1 (also see FIG. 2).

When holder 10 is disposed in stand 11 with projection 10*b* being received in cavity 11*b* to form a ball and socket assembly and with projection 10*a* being disposed in channel 11*b*, holder 10 is permitted to pivot about two orthogonal axes. It should be apparent to those skilled in the the art that the two orthogonal axes about which member 10 can pivot are shown at reference A and reference B in FIG. 4. As aforementioned, projection 10*a* and channel 11*a* inhibit member 10 from rotating about a third axis, that axis being shown at reference C in FIG. 4. Copper alloy 725 or 688 bright with a relatively thin plating of tin is preferably used when manufacturing lead frame 12. Thus, lead frame 12 provides good electrical conductivity paths for coupling thermal printhead 6 with other circuitry disposed on printed circuit board 13 for instance. The material of lead frame 12 as well as the fact that it is disposed in its two aforementioned major planes provides it with good flexibility for permitting holder 10 to rotate about axes A and B (FIG. 4). When holder 10 rotates about axis A in FIG. 4, it may rotate generally toward or away from platen 3 (see FIG. 2). Member 10 is in fact urged toward platen 3 by the action of spring 17, one end of which is attached to opening 10*f* in holder 10 and the other end of which is attached to base 1*a*. As aforementioned, holder 10 also rotates about axis B which is important to permit printheads 6 to contact end of paper 7.1 with essentially even pressure across the width of substrate 5. It is important that holder 10 not only rotate about axis A, that axis being essentially parallel to the axis of spindle 4, but also rotate about axis B to permit the printheads 6 supported by holder 10 to be applied with substantially equal pressure across the entire printhead. Thus uniform print density and clarity is achieved using components which are easily and inexpensively manufactured and assembled. It should be appreciated by those skilled in the art, that when member 10 rotates about axis B the extent of rotation is generally limited by distance D shown in FIG. 4. However, this distance, which may be on the order of a fraction of an inch, will be found to suffice for most embodiments using a reasonable construction tolerance. It should also be appreciated by those skilled in the art that by mounting printed circuit board 13 in a plane essentially parallel to the major plane of holder 10 and connecting the same via lead frame 12, that a simple design having a minimum number of parts results and holder 10 is provided its ability to rotate about two axes.

Having described the invention in connection with a specific embodiment thereof, modification may now suggest itself to those skilled in the art. For example some practicing the invention may desire that lead frame 12 urge holder 10 toward platen 3 thereby performing the function of spring 17. It is to be understood that this invention is not limited to the specific embodiment disclosed, except as set forth in the appended claims.

What is claimed is:

1. A printer mechanism comprising:

(a) a platen;

(b) means for rotatably mounting said platen;

(c) a medium upon which printing is to be accomplished, said medium being disposed adjacent to said platen;

(d) printing means;

(e) holder means for disposing said printing means in printing relationship to said medium and said platen; and (f) pivoting means for pivoting said holder means about a first and second axes with respect to said platen, said pivoting means including a ball and socket assembly and means for inhibiting said holder means from pivoting about a third axis, said third axis being orthogonal to both said first and second axes.

2. The printer mechanism according to claim 1, further including a lead frame assembly disposed in two major planes and having an end which is attached to said holder means.

3. The printer mechanism according to claim 2, further including a base and wherein said means for rotatably mounting said platen is attached to said base and a portion of said ball and socket assembly is attached to said base.

4. The printer mechanism according to claim 3, wherein one of the two major planes in which said lead frame assembly is disposed is essentially parallel to a major plane of said holder means.

5. The printer mechanism according to claim 4, wherein the other of the two major planes in which said lead frame assembly is disposed is essentially normal to the major plane of said holder means.

6. The printer mechanism according to claim 5, further including a printed circuit board having means connecting said lead frame assembly therewith, said printed circuit board being disposed in a plane essentially parallel to the major plane of said holder means.

7. The printer mechanism according to claim 6, further including spring means for urging the printing means toward said platen and for automatically adjusting the printing relationship between said printing means and said medium with respect to said first and second axes.

8. The printer mechanism according to claim 7, wherein said spring means is attached to said holder and to said base.

9. The printer mechanism according to claim 8, further including a lead frame assembly having an end of which is attached to said holder means.

10. A printer mechanism according to claim 2, further including a printed circuit board disposed in a plane essentially parallel to a major plane of said holder means, said printed circuit board being attached to ends of said lead frame assembly.

11. The printer mechanism according to claim 1, wherein said printing means is provided by a thermal printhead mounted on a substrate and wherein said holder means includes an opening for receiving a portion of said substrate.

12. The printer mechanism according to claim 11 further including a lead frame assembly having an end of which is attached to said holder means.

13. The printer mechanism according to claim 12, wherein said substrate includes a plurality of conductive ribbons coupled to said thermal printheads and wherein the ends of said lead frame assembly attached to said holder means form contacts which mate with said conductive ribbons when said substrate is received in said opening.

14. A printer mechanism comprising:

(a) a medium upon which printing is to be accomplished;

(b) a substrate mounting a plurality of groups of thermal printing elements;

(c) holder means for disposing said groups of thermal printing elements in printing relationship to said medium, said holder means including first and second projections;

(d) receiving means for receiving said first projection to permit said holder means to pivot about first and second axes; and (e) channel means defining a channel, said second projection being disposed in said channel means to inhibit said holder means from pivoting about a third axis.

15. The printing mechanism according to claim 14, wherein said third axis is orthogonal to said first and second axes.

16. The printing mechanism according to claim 15, wherein said first axis is orthogonal to said second axis.

17. The printing mechanism according to claim 16, further including a base and a stand attached to said base, said stand including said receiving means and said channel means.

18. The printing mechanism according to claim 17, wherein said first projection and said receiving means form a ball and socket assembly.

19. The printing mechanism according to claim 14, wherein said first projection and said receiving means form a ball and socket assembly.

20. The printing mechanism according to claim 14, further including a lead frame assembly disposed in two major planes and having an end which is attached to said holder means.

21. The printing mechanism according to claim 20, wherein one of the two major planes in which said lead frame assembly is disposed is essentially parallel to a major plane of said holder means.

22. The printing mechanism according to claim 21, wherein the other of the two major planes in which said lead frame assembly is disposed is essentially normal to the major plane of said holder means.

23. The printing mechanism according to claim 22, further including a printed circuit board having means connecting said lead frame assembly therewith, said printed circuit board being disposed in a plane essentially parallel to the major plane of said holder means.

24. The printing mechanism according to claim 23, further including a platten and spring means for urging the printing means toward said platten and for automatically adjusting the printing relationship between said printing means and said medium with respect to said first and second axes.

* * * * *